United States Patent [19]

Azzerri et al.

[11] 4,213,839

[45] Jul. 22, 1980

[54] PROCESS FOR IMPROVING THE ADHESION OF PAINT TO STEEL SHEETS

[75] Inventors: Nazzareno Azzerri, Pomezia; Roberto Bruno; Massimo Memmi, both of Rome, all of Italy

[73] Assignee: Centro Sperimentale Metallurgico S.p.A., Rome, Italy

[21] Appl. No.: 28,925

[22] Filed: Apr. 9, 1979

[30] Foreign Application Priority Data

Apr. 14, 1978 [IT] Italy ..... 48908 A/78

[51] Int. Cl.[2] ..... C25D 13/20

[52] U.S. Cl. ..... 204/181 R; 204/181 C

[58] Field of Search ..... 204/181 R, 181 C, 181 T

[56] References Cited

U.S. PATENT DOCUMENTS 3,620,949 11/1971 Morrison et al. ..... 204/181 R

*Primary Examiner*—Howard S. Williams

*Attorney, Agent, or Firm*—Young & Thompson

[57] ABSTRACT

The adhesion of paint to steel sheets is improved by pretreating the steel sheets, prior to conventional annealing, surface finishing, oiling, degreasing, phosphating and painting operations, by connecting the steel sheet alternately as cathode and anode in an electrolytic cell containing a bath of 0.5 M-2 M sodium sulphate aqueous solution. The operating temperature is 20°-100° C., the pH is 6-8, the current density is 1 to 50 A/dm$^2$, and the treatment time is 0.1-30 seconds, preferably 0.5-20 seconds, and most preferably about 5 seconds as cathode followed by about 5 seconds as anode.

5 Claims, 2 Drawing Figures

PROCESS FOR IMPROVING THE ADHESION OF PAINT TO STEEL SHEETS

Figure 1:
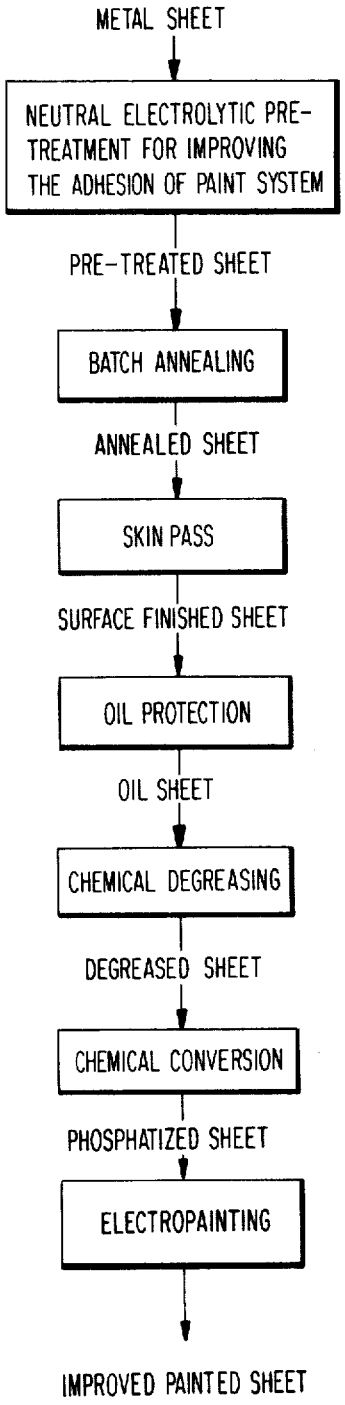

The present invention relates to improving the adhesion of paint systems to metal sheets, more particularly to steel sheets such as those used, for example, in the automotive industry. The invention consists in a pretreatment which is applied to the metal sheet before the latter is subjected to the conventional steps leading up and including painting, including for example surface conversion, i.e. phosphating.

The painting process according to the present invention, including the novel pretreatment, is based on the use of an electrolytic solution having an essentially neutral pH value, i.e. 6–8, and is characterized by the fact that the metal sheet is immersed in a sodium sulphate solution, over a particular temperature range and for particular periods of time, alternately as cathode and anode of the resulting electrolytic cell while a current of appropriate density flows through the cell.

The adhesion of paint systems is a problem which has been studied extensively in the past by many researchers. Of the many conclusions thus reached, perhaps the most interesting are the following:

First, it has been established that adhesion of the paint system is dependent on the homogeneity of the converted metal surface layer. This homogeneity is influenced negatively by the pressure on the surface of organic contaminating agents whose origin is either endogenous (e.g. graphite in steel sheets) or exogenous (e.g. residues of rolling mill lubricants) as a result of lubricant cracking.

Second, it has been thought that the presence of inclusions within the metal surface (e.g. manganese sulphides and oxides in the case of steel sheets) has a beneficial influence on the homogeneity of the converted surface layer, since the reactivity of the latter is increased by the inclusions.

Techniques for improving paint adhesion in the past, based on the theoretical results recited above, were directed first of all toward the removal of organic contaminants: for steel sheets, the method adopted was based on degreasing the sheet in an alkaline electrolytic solution prior to annealing. The theoretical indication with regard to the beneficial effect of inclusions, however, was not pursued to the extent of increasing such inclusions, despite the belief that to do so would have improved the adhesion of paint systems.

The present invention comprises the startling discovery that, contrary to what had heretofore been assumed concerning surface inorganic inclusions, not the increase of such inclusions but rather their removal improves the adherence of paint systems to steel sheets.

In accordance with this discovery, the present invention provides a painting process including as a pretreatment, a method of removing such inorganic inclusions (manganese oxides and sulphides in the case of steel sheets) and also at the same time removing organic residues from the surface of the sheet, both in a single comprehensive treatment.

Apart from the pretreatment which particularly characterizes the present invention, the steps up to and including painting can be quite conventional. Thus, the steel sheet pretreated according to the present invention can be batch annealed, skin passed, oiled, degreased, phosphatized, and finally painted by a conventional painting process. Incidently, the term "paint" used herein refers both to paints of the anaphoretic type, e.g. acrylic, and also paints of the cataphoretic type, e.g. epoxide paints. Preferred are the anaphoretic type, and particularly preferred is acrylic.

However, it is to be understood that the present invention is not the pretreatment alone, but rather the pretreatment in combination with painting, whereby improved adhesion of the paint system is achieved.

The pretreatment according to the invention consists in inserting the steel sheet alternately as cathode and anode in an electrolytic cell particular operating conditions. The electrolyte used consists essentially of sodium sulphate aqueous solution in a concentration range of 0.5 M–2 M, at a temperature between 20° and 100° C. and a current density between 1 and 50 A/dm2. The treatment time is 0.1–30 seconds, preferably 0.5–20 seconds, and most preferably about 5 seconds as cathode followed by about 5 seconds as anode.

The process can be performed continuously on strip, or batchwise on separate metal sheets. If continuously, then the strip will be alternately cathode-anode-cathode-anode-cathode-anode-cathode, etc.; while if batchwise, the sheets will be connected first as cathode and then as anode.

The present invention is not to be confused with that of U.S. Pat. No. 4,127,450, which relates to the electrotinplating of steel. In that earlier patent, it was found that the polarization resistance of electrotinplated steel was increased more than 20% by giving the steel a pretreatment somewhat similar to the pretreatment of the present invention. The present invention, however, is unobvious in view of that earlier patent, because, with a knowledge of the fact that the polarization resistance of an electrotinplated steel sheet is increased by such a pretreatment, it was totally unforeseeable that the adhesion of a paint system to steel sheet would be improved by such a pretreatment.

Figure 2:
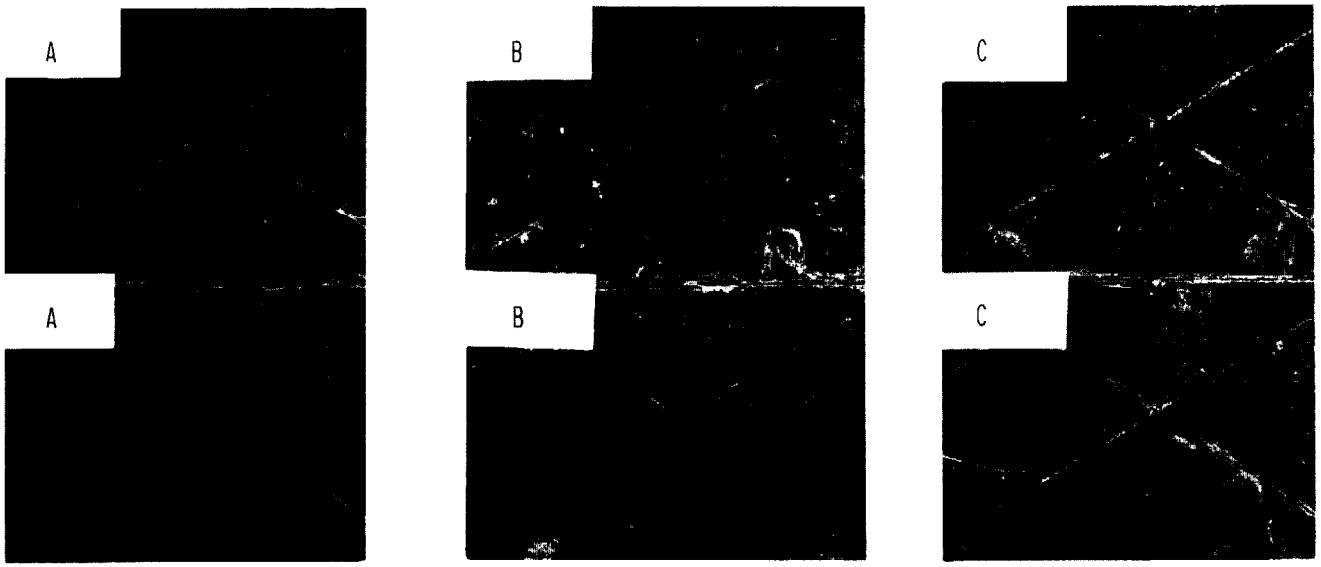

Other features and advantages of the present invention will become apparent from a consideration of the following description, taken in connection with the accompanying drawings, in which:

FIG. 1 is a block schematic diagram showing the treatment of a metal sheet according to the present invention, and in which the pretreatment according to the invention is shown as a part of the complete process for producing painted metal sheets; and FIG. 2 is a series of photographs illustrating the adhesion of paint systems to steel sheets produced according to the present invention (A) and according to techniques lying outside the present invention (B and C).

In order to enable those skilled in this art to practice the invention, the following illustrative examples are given:

EXAMPLE 1

A 0.8 mm thick sheet of killed steel of the type FePo4 (KE) having the following weight percent composition:

0.040 C
0.010 Si
0.29 Mn
0.008 P
0.013 S
0.041 Al balance essentially iron, was pretreated according to the present invention by being immersed in an electrolytic cell containing a 1.5 M sodium sulphate aqueous solution at 40° C. The sheet was connected for 5 seconds as cathode and then for 5 seconds as anode, at a current density of 20 A/dm$^2$. The sheet was then subjected to the entirely conventional steps of annealing, skin passing, oiling with corrosion preventing grease, degreasing at 70° C. with a solution of a commercial detergent, spray phosphating, and painting with acrylic by the electrophoretic technique.

EXAMPLE 2

As an example of operation according to the prior art, Example 1 was repeated, but the pretreatment in the electrolytic cell was omitted.

EXAMPLE 3

As another example of operation according to the prior art, Example 1 was repeated, but instead of the specified pretreatment in the electrolytic cell, the sheet was degreased electrolytically prior to annealing by immersing it in an aqueous solution of 25 g/l sodium hydroxide, and 25 g/l sodium phosphate at a temperature of 87° C., connected alternately as cathode and anode at a current density of 10 A/dm$^2$, for one second at each polarity for a total of 10 seconds.

The painted sheets produced by Examples 1, 2 and 3 were then cut so as to provide a number of specimens each 10×20 cm. Two grooves in the shape of a cross were cut on the painted faces of the specimens so as to expose the bare metal substrate. The specimens were then placed in a salt spray testing chamber where they were subjected to a salt spray of 5% sodium chloride at 30° C. The results were evaluated by visual inspection of the amount of bubbling present on the painted surface and of the extent of sub-skin corrosion penetration (measured by the widening of the grooves).

FIG. 2 shows the results obtained, in which the specimens according to the invention, that is, of Example 1 are designated A; those of Example 2 as B and those of Example 3 as C.

As will be seen from FIG. 2, the A specimens were completely free of bubbles; the B specimens suffered widespread bubbling and severe corrosion; while the C specimens had fewer bubbles than B but still substantially numbers of bubbles and more sub-skin corrosion penetration than A.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A method of producing on a steel sheet a paint system of improved adhesion to the sheet, comprising the steps of immersing a steel sheet in an aqueous solution of sodium sulphate of a concentration from 0.5 M to 2 M at a pH of 6 to 8 at a temperature of 20° to 100° C., connecting the immersed part alternately as cathode and anode for a period of time between 0.1 and 30 seconds at a current density of 1 to 50 A/dm$^2$, and subsequently painting said sheet.

2. A method as claimed in claim 1, in which said period of time is 0.5 to 20 seconds.

3. A method as claimed in claim 1, in which said period of time is about 10 seconds and said sheet is connected first as cathode for about 5 seconds and then as anode for about 5 seconds.

4. A method as claimed in claim 1, in which the total time said sheet is connected as cathode is about the same as the total time said sheet is connected as anode.

5. A painted steel sheet produced by the method of claim 1.

* * * * *